US005787603A

United States Patent [19]

Steiner et al.

[11] Patent Number: 5,787,603

[45] Date of Patent: Aug. 4, 1998

[54] PRESSING THE WEB TO THE DRYER IN A DRYER SECTION

[75] Inventors: Karl Steiner, Herbrechtingen; Karlheinz Straub, Heidenheim, both of Germany

[73] Assignee: Voith Sulzer Papiermaschinen GmbH, Heidenheim, Germany

[21] Appl. No.: 738,478

[22] Filed: Oct. 28, 1996

Related U.S. Application Data

[63] Continuation-in-part of Ser. No. 707,195, Aug. 20, 1996, abandoned.

[30] Foreign Application Priority Data

Oct. 27, 1995 [DE] Germany ..... 195 40 003.8

[51] Int. Cl.[6] ..... D21F 5/00

[52] U.S. Cl. ..... 34/117; 34/120

[58] Field of Search ..... 34/113, 116, 117, 34/118, 120; 162/358.1, 358.7, 358.3, 358.5

[56] References Cited

U.S. PATENT DOCUMENTS

| | | | |
|---|---|---|---|
| 3,206,869 | 9/1965 | Justus | 34/113 |
| 4,194,947 | 3/1980 | Houstila et al. | 34/116 X |
| 4,738,035 | 4/1988 | Grebe et al. | 34/116 X |
| 4,750,275 | 6/1988 | Sando et al. | 34/113 |
| 4,889,048 | 12/1989 | Miller | 34/116 X |
| 4,922,627 | 5/1990 | Hernandez | 34/113 X |
| 5,092,962 | 3/1992 | Koski | 162/359 |
| 5,545,295 | 8/1996 | Fujita et al. | 162/358.1 |
| 5,553,392 | 9/1996 | Hanaya | 34/116 X |

*Primary Examiner*—Henry A. Bennett
*Assistant Examiner*—Steve Gravini
*Attorney, Agent, or Firm*—Ostrolenk, Faber, Gerb & Soffen, LLP

[57] ABSTRACT

The dryer section of a machine for manufacturing a paper web includes at least one and more usually a plurality of heatable drying cylinders, each of which is wrapped over a part of its circumferential surface by the web of material to be dried. A support belt is guided by guide rolls to wrap over a part of the circumference of each of the drying cylinders and over the web. A pressing device presses against the support belt to press the web of material against the drying cylinder. That pressing device may comprise a pressure box outside the support belt to which air or steam pressure is applied. The pressure box may include several zones either along the web path or transverse to the web path permitting different pressures to be applied. The pressing device may alternately comprise a plurality of pressing rolls extending transversely to the web axis and parallel to the drying cylinder axis and being biased against the support belt, e.g., by springs, and supported on a support which moves the pressing rolls toward the support belt.

26 Claims, 8 Drawing Sheets

FIG. 1
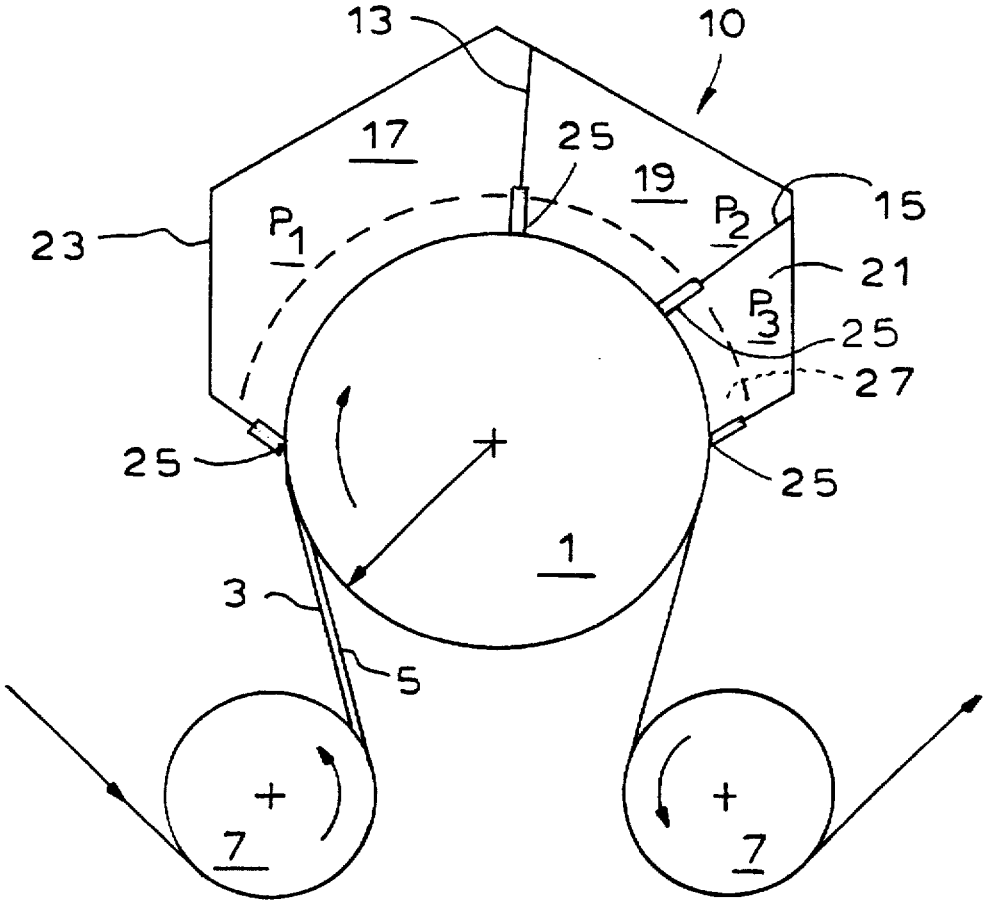
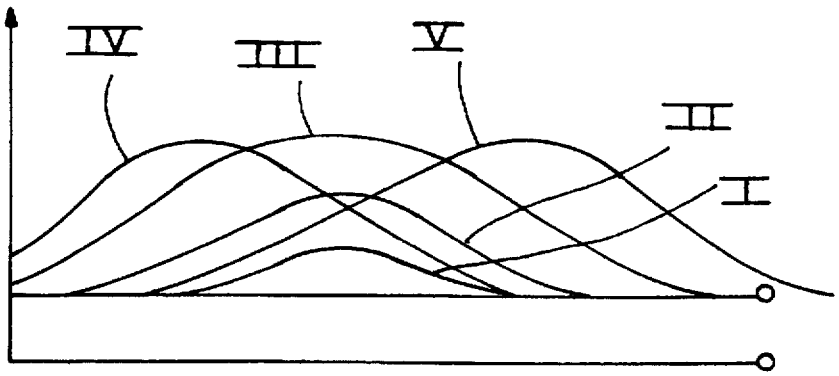
FIG. 6

PRESSING THE WEB TO THE DRYER IN A DRYER SECTION

CROSS REFERENCE TO RELATED APPLICATION

This is a continuation-in-part of application Ser. No. 08/707,195, filed Aug. 20, 1996 now abandoned.

BACKGROUND OF THE INVENTION

The present invention relates to a dryer section of a machine for the manufacture of a web of material, particularly paper, and particularly relates to a device which presses the web to be dried against the surface of the drying cylinder.

Dryer sections of this type are known. One frequent problem is that the drying contact between the web of material and the surface of the drying cylinder is not sufficient in order for the energy present in the drying cylinder to be optimally transmitted to the paper web which is to be dried.

An increase in the drying contact can be obtained by applying a greater initial tension to a web support belt, which is like a dryer felt, and is conducted, together with the web of material, around the drying cylinders. This is possible only with appropriate adjustment of the structural parts which participate in guiding the support belt, for instance by providing larger guide roll and drying cylinder bearings. The initial stress is furthermore limited by the maximum load bearing capacity of the support belt.

SUMMARY OF THE INVENTION

It is therefore an object of the present invention to provide a dryer section which does not have the foregoing disadvantages and which permits pressing of the web against the cylinders without stressing the support belt or its guidance elements.

The pressing device of the invention presses the web of material against the drying cylinder for achieving a better transfer of heat.

In a preferred embodiment of the dryer sections the pressing device is developed to apply different pressures at different locations over the circumference of the drying cylinder. Different pressures may be applied along the circumference and/or transverse to the axis of the dryer by applying respective selected, perhaps different pressures at different zones of the circumference. This enables the drying behavior to be adjusted in a particularly sensitive fashion.

In one preferred embodiment of the dryer section, the pressing device is developed as a pressure box. Such an embodiment can be used at favorable cost since air under pressure is in any event available for controlling the guidance of the web of material, and this air can be conducted into the pressure box.

In one particularly preferred embodiment, the pressure box has zones, known as pressure chambers, by which different pressures can be applied in the direction of web travel and/or transverse to the direction of web travel. The heat transfer to the web of material can therefore be controlled not only around the circumference of the drying cylinder but also over its length.

In a dryer section which typically has several drying cylinders, several drying cylinders of the dryer section are provided with pressing devices which are developed as pressure boxes. The pressure boxes may be constructed in identical manner and they may have zones which can apply respective different pressure levels. The dryer section can be developed in a particularly simple manner if the same, i.e. correspondingly located, zones of different pressure boxes on different cylinders are acted on with the same respective pressures.

In yet another preferred embodiment of the dryer section, the pressure zones of different pressure boxes can be controlled separately so that different pressure levels can be established everywhere. In one such embodiment, the pressing upon the web of material can be adjusted in a particularly sensitive manner over several drying cylinders.

In a second preferred embodiment of the dryer section, the pressing device comprises several pressing rolls which press upon the support belt for the web. The central axes of these rolls are arranged substantially parallel to each other and preferably parallel to the axis of rotation of the drying cylinder, as well as on an imaginary arcuate line. This development has the advantage that the pressing device assures an increased pressure without feeding in external energy. The pressure rolls may be supported in a support device that may be adjustable to apply the rolls against the support belt and may perhaps be elastically biased toward that belt.

Other features and advantages of the present invention will become apparent from the following description of the invention which refers to the accompanying drawings.

BRIEF DESCRIPTION OF THE DRAWINGS

FIG. 1 is a basic schematic diagram showing the function of a pressing device developed as a pressure box;

FIG. 6 is a diagram showing the pressures prevailing over the circumferential surface of the drying cylinder;

DESCRIPTION OF PREFERRED EMBODIMENTS OF THE INVENTION

Figure 2:
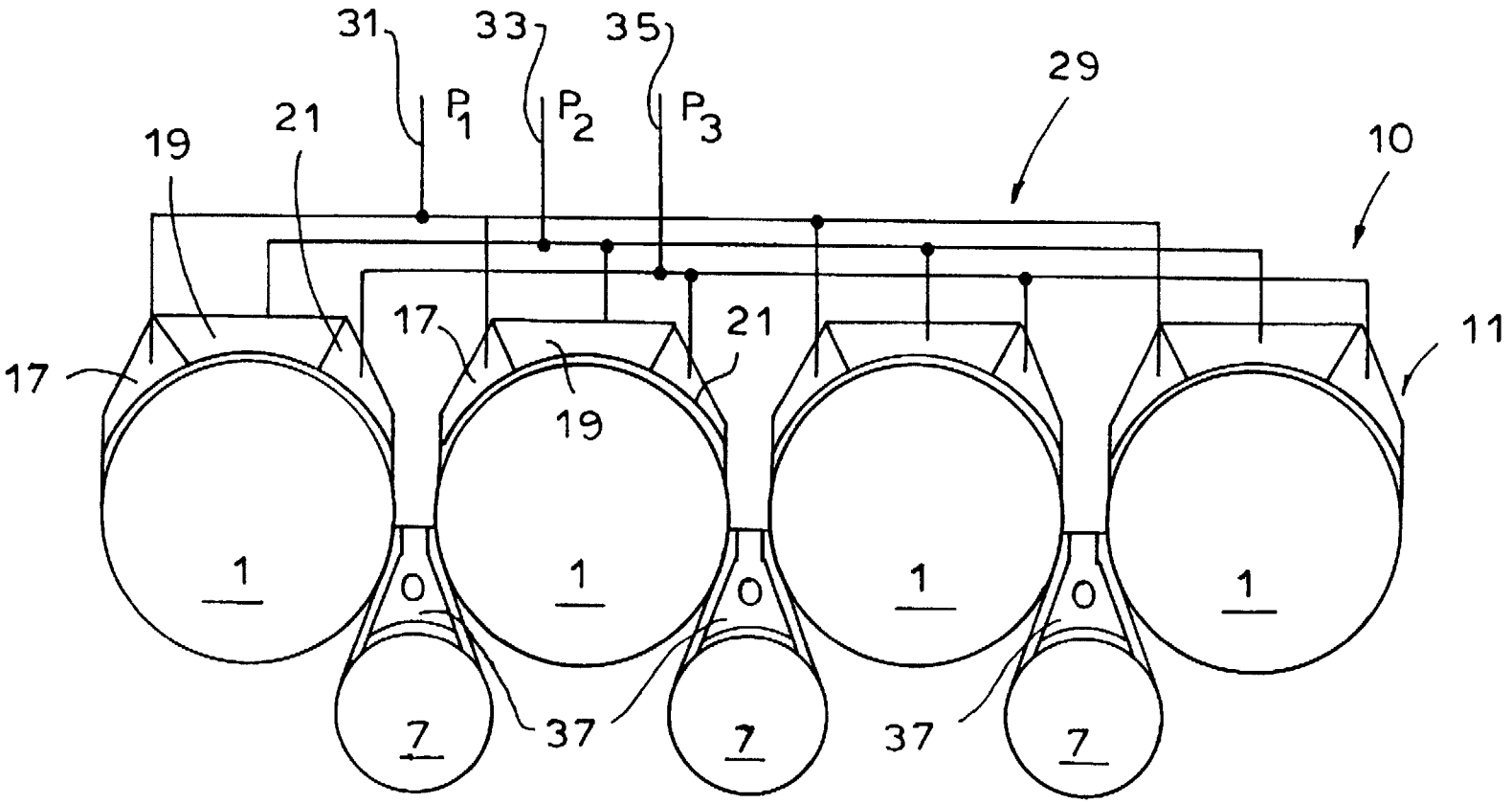
FIG. 2 is a diagrammatic view of the end of a first embodiment of a dryer section.

FIG. 1 shows, very diagrammatically, an end view of a drying cylinder 1 of a dryer group comprised of several drying cylinders, the group being one of several groups of a drying section. Such a grouping of cylinders to define a drying section is conventional. A support belt 3, developed for instance as a drying section wire, is conducted over the periphery of the cylinder 1 together with a web of material to be dried, for instance a paper web 5. The paper web and the support belt wrap around only part of the circumference or surface of the drying cylinder with the belt outside of and pressing on the web. In order to increase the circumferential area of contact and the angle of wrap between the heated surface of the drying cylinder and the paper web which is to be dried, belt guide rolls 7 are provided in the feed and run-off regions of the drying cylinder. The direction of rotation of those guide rolls depends on the direction of travel of the paper web and is here indicated by arrows.

To improve the heat transfer from the drying cylinder 1 to the paper web, the paper web 5 is adjusted by a predetermined tension of the support belt. To further improve the drying contact with the surface of the drying cylinder 1, a pressing device, developed as pressure box 11, preferably extends over the entire axial length of the drying cylinder 1 and over most, if not all, of the angle of wrap of the belt on the cylinder.

The pressure box 11 has several inner walls 13 and 15 which extend preferably over the entire length of the pressure box. Those walls define several, in this case three, pressure chambers 17, 19, 21 in the box 11. A pressure level for pressing the support belt 3 and thus the paper web 5 against the surface of the drying cylinder 1 is provided for improved transfer of heat. This pressure level is established in the pressure chambers in some suitable manner, for instance, by feeding in air.

The respective pressure levels $p_1$, $p_2$, $p_3$ in the pressure chambers 17, 19 and 21 can be set by respective pressure control means to be at desired values to assure optimal drying behavior of the paper web 5. The pressure levels can be set, for instance according to the inequality $p_1<p_2>p_3$ or the inequality $p_1>p_2>p_3$.

Figure 7:
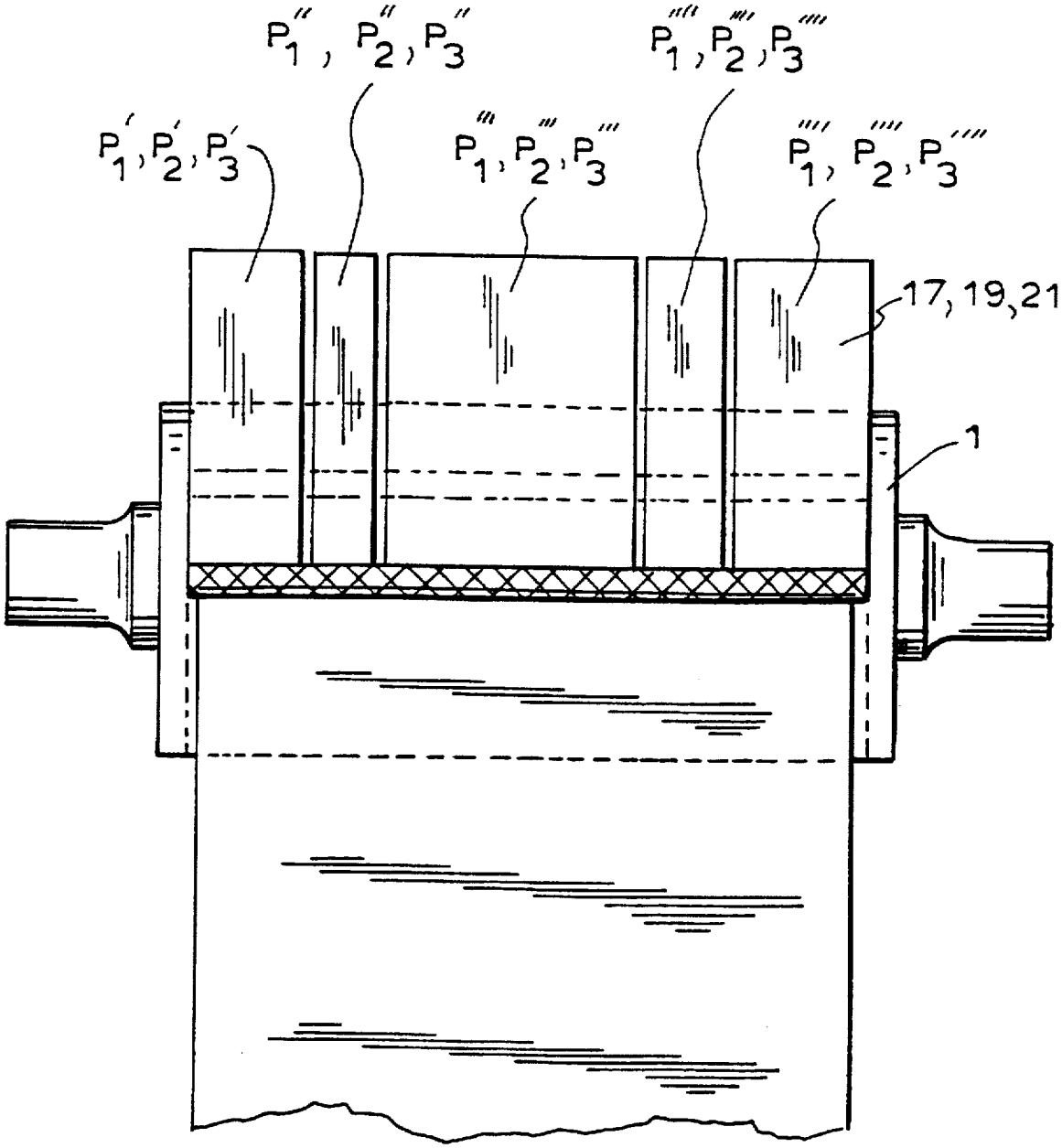
FIG. 7 is a side view of a pressing device at one pressing roll.

In addition to being divided along the web path along the circumference of the dryer, FIG. 7 shows how all of the pressure chambers 17, 19 and 21 can be subdivided over their longitudinal direction, and therefore over the width of the paper web 5, to enable different pressure values e.g., P1', P2', P3'; P1", P2", P3", etc. to be set transverse to the direction of travel of the paper web. Subdivision simultaneously over both of the longitudinal (i.e., transversely to the circumferential) and circumferential directions is possible, producing a matrix of local are a pressure chambers.

The longitudinal edges of the housing 23 of the pressure box 11 which adjoin the surface of the drying cylinder 1 and the longitudinal edges of the partitions 13 and 15 which face the circumferential surface of the drying cylinder 1 are all provided with sealing strips 25 which substantially prevent loss of pressure from the pressure chambers. Instead of the sealing strips 25, so called air knives can also be used for providing contactless sealing of the pressure chambers can be effected. The housing 23 is furthermore provided at its front end and on the opposite rear side with sealing strips 27, indicated here in dashed line.

It is possible to adjust the pressure conditions within the pressure box 11 by the sealing behavior of the sealing strips 25 and 27. For example, a gentle transition in pressure between the pressure chambers 17, 19 and 21 can be obtained because the sealing strips 25 provided on the inner walls 13 and 15 permit transfer of air and thus permit equalization of pressure. Similarly, upon the entrance and emergence of the paper web 5 into and out of the pressure box, equalization of pressure may be desired in order to assure a gentle transition of pressure here also.

Finally, it is also possible to develop the sealing strip 27 on the front and rear sides of the housing 23 so that pressure equalization is also here possible in order to achieve a gentle pressure transition. This presses the edge of the web of material 5 against the drying cylinder 1 with less pressure, which counteracts excess drying of the edges of the web.

FIG. 2 very diagrammatically shows the end of a first embodiment of a dryer section 10 which has several drying cylinders 1 arranged alongside of each other along the direction of web movement. In the embodiment shown a pressing device developed in the form of a respective pressure box 11 is associated with each drying cylinder. Each of the pressure boxes has three pressure chambers 17, 19 and 21. The chambers are acted on by compressed air via conduits 29. Compressed air at a pressure level $p_1$ is fed via a first connecting line 31 to act on each pressure chamber 17. The middle pressure chambers 19 of the pressure boxes 11 are acted on via a second connecting line 33 which supplies air at a pressure level $p_2$. Finally, air at a pressure level $p_3$ is fed to the pressure chambers 21 of the pressure boxes 11 via a third connecting line 35.

It is thus clear that the same sequence of pressure levels $p_1$, $p_2$ and $p_3$ is fed in all pressure boxes so that the corresponding pressures act on each dryer. The same relative pressure levels in the same sequence may be set with pressure levels p1', p2', p3'; p1", p2", p3; etc. in FIG. 7. However, since pressure can be separately and individually supplied to each chamber both around and longitudinally along the drying cylinder, there may be separate pressure boxes around the circumference and transversely to the circumference, i.e., along the length of the cylinder, each supplying their own respective individual pressures.

In the dryer section 10 shown, the support belt 3 and the paper web 5 are conducted along a meandering shape path over drying cylinders 1 and over the guide rolls 7 arranged between every two drying cylinders. An external suction box 37 is also present between every two drying cylinders which assures they draw off entrained air, and this assures particular guidance of the paper web.

Figure 3:
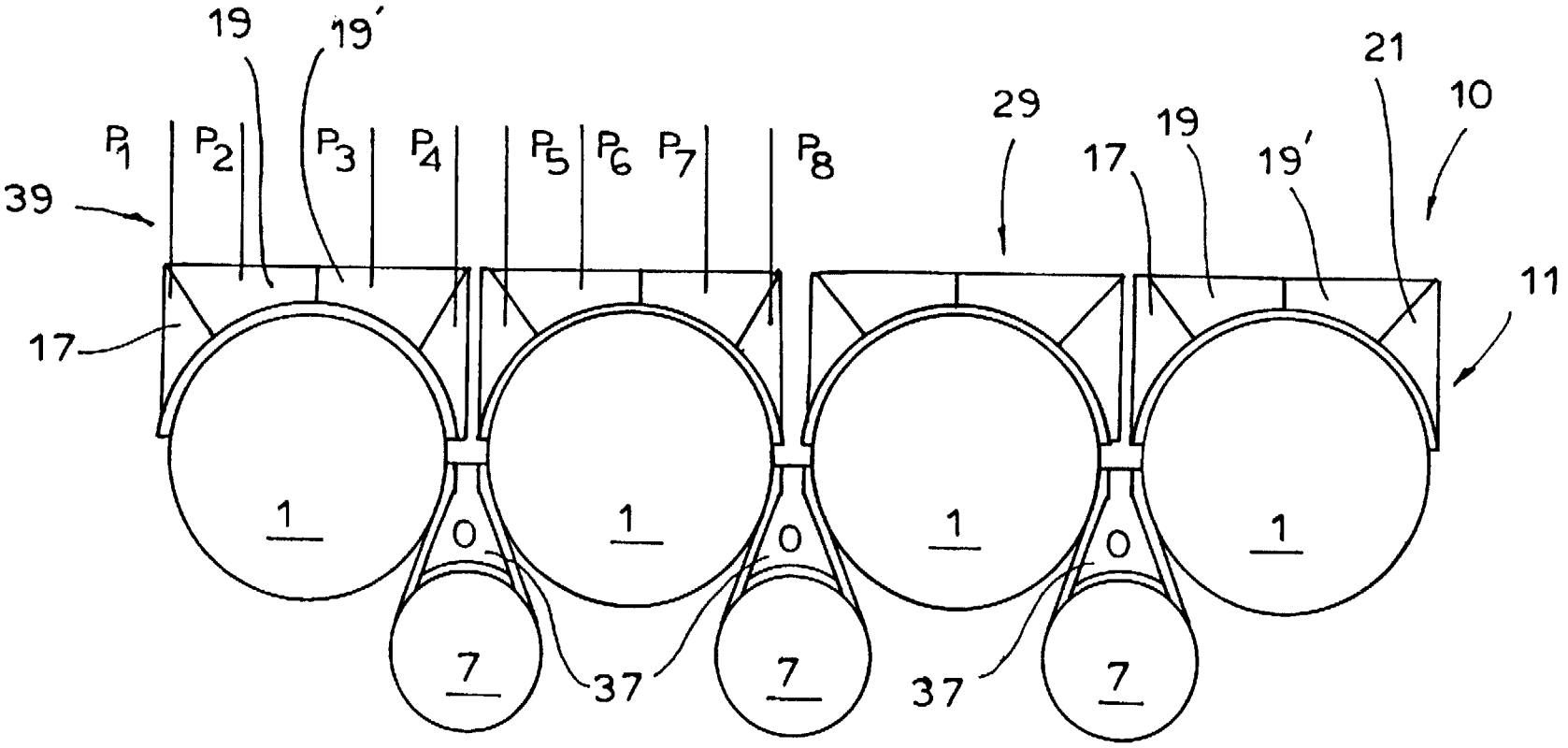
FIG. 3 is a diagrammatic view of the end of a second embodiment of a dryer section.

FIG. 3 shows a diagrammatic end view of another embodiment of a dryer section 10. In this case, four drying cylinders 1 are shown as an example. Between every two drying cylinders, guide rolls 7 are again provided, so that the support belt 3 and the paper web 5 can be guided in their meander path over the drying cylinders 1. The tensile force of the support belt 3 presses the paper web 5 against the heated surfaces of the drying cylinders. Again, pressing devices developed as pressure boxes 11 are provided for each drying cylinder. In this case, the pressure boxes each have four pressure chambers 17, 19, 19' and 21. The chambers are provided with pressure via separate pressure lines 39.

The indicated pressure levels $p_1$, $p_2$, . . . $p_8$, . . . in the different pressure chambers in FIG. 3 show that all pressure chambers of all pressure boxes 11 at all of the drying cylinders may have a respective pressure level of their own which is independent of the pressures in the other pressure chambers. Such a development of the dryer section 10 makes it possible to establish different pressures along the direction of travel of the paper web and thus assures an individual drying behavior. The arrangement shown in FIG. 7 also may be combined into FIG. 3.

In the embodiment of the dryer section 10 in FIG. 3, suction boxes 37 are also provided between every two drying cylinders 1. The suction boxes 37 are connected with a suitable source of vacuum, for instance a vacuum pump, not shown here. The exhaust air of the suction boxes or a vacuum pump can be dried by subsequent units and possibly heated and can then be fed to the pressure chambers.

Figure 4:
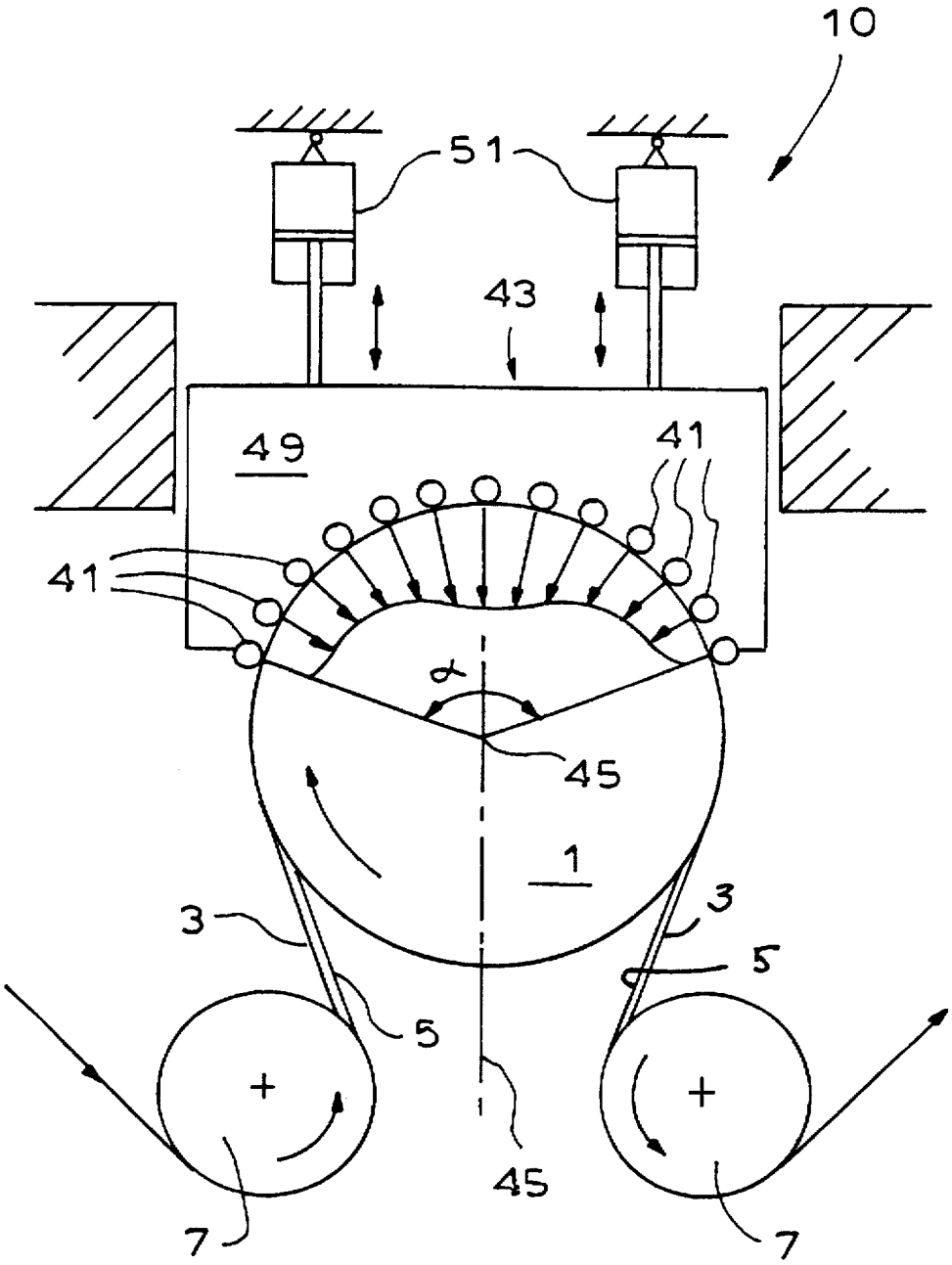
FIG. 4 is a basic diagram explaining the function of a pressing device having several pressing rolls.

FIG. 4 shows a diagrammatic end view of a drying cylinder 1 over which a wire belt 3 is conducted together with a paper web 5 by means of guide rolls 7. The paper web 5 wraps around a part of the circumference of the drying cylinder to be heated on the heated surface of the cylinder. The pressures are in this case also determined by the tensile force of the wire belt. In addition, a pressing device 43 having pressing rolls 41 arranged alongside each other circumferentially around part of the circumference of the cylinder is provided to press the paper web 5 together with the wire belt 3 against the surface of the drying cylinder 1.

The central axes of the pressing rolls 41 are arranged substantially parallel to each other and preferably parallel to the axis of rotation 45 of the drying cylinder. They lie on an imaginary arcuate line which follows the circumferential contour of the drying cylinder 1 and in the embodiment shown, that line is developed as a circular arc which is arranged substantially concentric to the outer surface of the drying cylinder 1.

Figure 8:
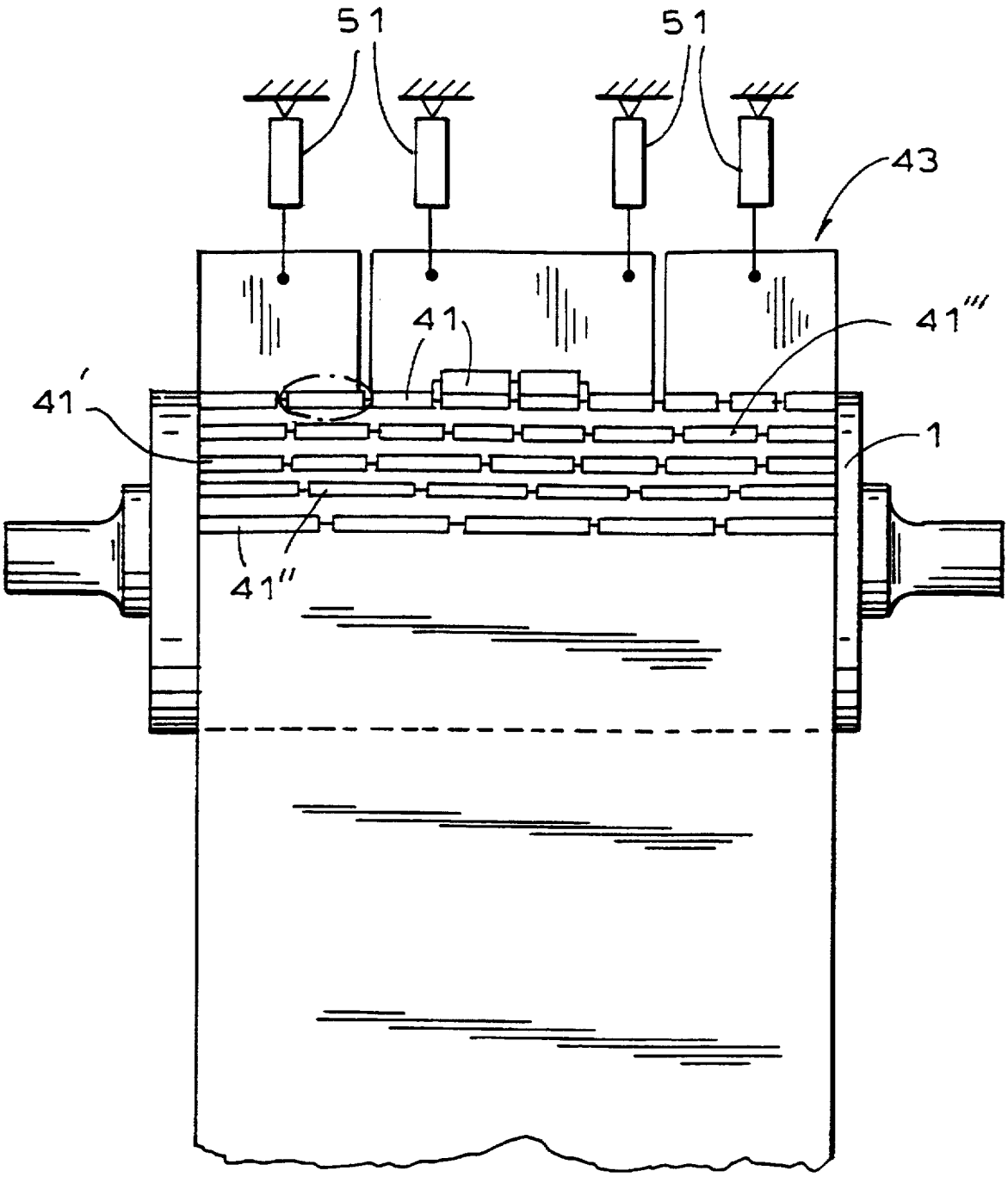
FIG. 8 is a side view of an alternate embodiment thereof.

The pressing rolls can extend continuously over the entire length of the drying cylinder. However, as shown in FIG. 8, it is also possible to divide the pressing rolls into individual partial rolls which are arranged one behind the other, with their central axes substantially aligned. One axial direction row of such partial rolls 41', 41", 41'" is indicated, and other such rows around the circumference of the drying cylinder can be seen. The arrangement of partial rolls may be coordinated with the respective different pressure chambers along the length of the roll, as shown in FIG. 7, enabling different pressures to be applied by different partial rolls 41', etc.

When the pressing rolls 41 are pressed against the circumferential surface of the drying cylinder 1, only the radial component of the pressure of a pressing roll increases the pressure. It can therefore be noted that the pressing rolls which act perpendicularly from above on the surface of the cylinder apply a higher pressure than those which are pressed from above on a region of the circumferential surface of the drying cylinder which lies at a distance from the central plane 47 of the drying cylinder 1. The greater the distance of a pressing roll from the central plane 47, the smaller is its pressure. This in part results from the rolls being supported in a device 49 which is urged downwardly from above or outside the support belt. Hence, the movement and pressure are applied by the device 49 from above, in the direction of the central plane 47.

As a whole, a substantially sinusoidally shaped pressure distribution is established. The pressures act symmetrically to the central plane 47, and the pressing rolls supply the greatest pressure in the region of the central plane. Arrows indicate the direction and by their length the magnitude of the useful component of force associated with each individual pressing roll 41 by which the paper web 5 and the wire belt 3 are pressed against the surface of the drying cylinder.

The pressing rolls 41 are held by a support device 49. That device, in turn, is held by at least one, and in the present case two, pressing devices 51. The devices 51 press the device 49 toward, and the rolls 41 against, the surface of the drying cylinder.

Use of two pressing devices 51 arranged at a distance from the central plane 47 permits the support device 49 to be acted on with different pressures, i.e., in different directions, so that the region of maximum pressures can be shifted.

It is further possible to also provide several pressing devices 51 over the length of the pressing device 43 along the length of the drying cylinder 1, as shown in FIG. 8, in order to vary the pressures along the longitudinal direction of the drying cylinder. The suspension of the pressing rolls 41 must be developed accordingly.

In the embodiment shown in FIG. 4, the distance between the pressing rolls is selected so that their circumferential lines almost touch each other. The pressures exerted on the circumferential surface of the drying cylinder 1 are therefore very uniform, particularly if the diameter of the pressing rolls is substantially less than the diameter of the drying cylinder 1. The arcuate region of the cylinder acted on with a pressure by the pressing rolls 41 extends over a circumferential angle $\alpha$ of about 130°.

FIG. 5 again shows a diagrammatic end view of a drying cylinder 1. The circumferential surface of the cylinder has a plurality of pressing rolls 41 of a pressing device 43 acting on it. The central axes of the pressing rolls are arranged substantially parallel to each other and preferably parallel to the axis of rotation 45 of the drying cylinder 1. Furthermore, these rolls are on an arcuate line having a radius of curvature which is greater than that of the drying cylinder 1.

The pressing rolls 41 are elastically supported in and biased and urged outward of their support device 49. For example, compression springs 53 cooperate with the mounting of the pressing rolls 41 and permit evasive or retracting movement of the pressing rolls 41. The compression springs 53 are so arranged in the illustrated embodiment that they are practically perpendicular to the arcuate line which connects the center points of the pressing rolls 41.

Because the radius of curvature of the arcuate line of the pressing rolls is slightly greater than that of the drying cylinder, the pressing rolls 41 which are arranged near to the central plane 47 are the first to contact the circumferential surface of the drying cylinder as the support device is moved inward toward the drying cylinder. The pressing rolls 41 which are arranged at a distance from this plane contact the circumferential surface of the drying cylinder only when the pressing rolls which are already in contact with the drying cylinder are moved back or retracted against the resistance of the compression springs 53.

When the path of evasion or retraction of the pressing rolls 41 arranged close to the central plane 47 is selected to be sufficiently large, the support device 49 can be pressed by means of the pressing devices 51 so far against the drying cylinder 1 that all pressing rolls 41 finally lie on the circumferential surface of the cylinder.

Figure 5:
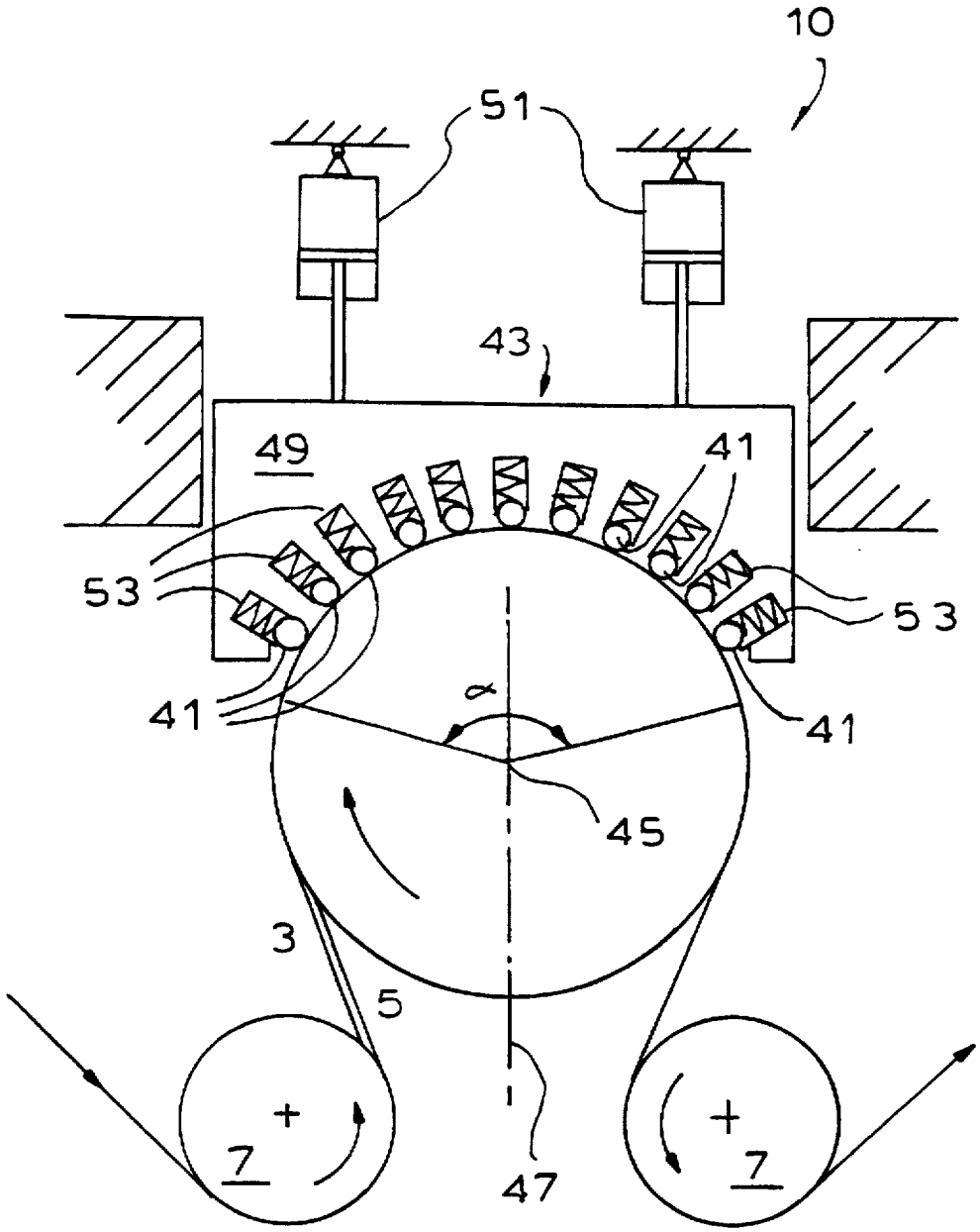
FIG. 5 is a basic diagram of a modified embodiment of a pressing device having pressing rolls.

FIG. 5 indicates the maximum region of the circumference which can at most be pressed upon by the pressing rolls 41. The circumferential region corresponds to a center angle a amounting to about 130°.

The component of force of the individual pressing rolls which is active for pressing is greater the closer the rolls are to the region of the central plane 47. The total circumferential region acted on with a pressure by the pressing device 43 is greater the further the support device 49 is moved in the direction towards the drying cylinder 1. By different activation of the pressing devices 51 which are arranged at a distance from the central plane 47, the region of the maximum pressure can be shifted around the circumference of the cylinder. As shown in FIG. 8, it is also possible to distribute several pressing devices 51 in the longitudinal direction of the drying cylinder 1 over the width of a paper web 5, in order to also produce different pressures along this direction.

In view of the foregoing, it is clear that the pressures exerted by the support belt 3 on the paper web 5 can be increased by the pressing device 43. The pressures can be further varied locally by providing compression springs 53 associated with respective pressing rolls 41 wherein the springs have spring constants which are different from each other. This enables the pressure distribution to be adjusted individually over the circumferential surface of the drying cylinder.

In the embodiment shown in FIG. 5, the support belt 3 and the paper web 5 are again wrapped by suitable guide rolls 7 around the drying cylinder 1. This produces an increased angle of wrap since the circumferential surfaces of the guide rolls 7 are separated by less than the diameter of the drying cylinder 1.

FIG. 6 shows the pressures over circumferential regions of the drying cylinder 1, the circumferential region being characterized by the corresponding center angle α.

The drawing graphs six different pressure curves, consecutively from 0 to V. The curve 0 shows that pressure caused only by the tensile stress of the support belt 3 acting over the region characterized by the center angle α.

The curve I shows that as the support device is moved toward the drying cylinder, over a small region of the circumference of the drying cylinder, pressures are built up which act symmetrically to the central plane 47. The central plane is included in FIG. 6 in order to show this.

Curves II and III indicate the pressure conditions which result upon further approach of the support device 49 toward the drying cylinder 1. The pressures both increase and extend over a wider circumferential region of the drying cylinder until, as indicated by curve III. The circumferential region designated by the center angle α is finally acted on with an additional pressure which exceeds the wire tension or support belt tension.

In the pressing device 43 shown in FIGS. 4 and 5, which has a plurality of pressing rolls, due to the use of relatively small pressing rolls, a relatively uniformly distributed pressure on the circumferential surface of the drying cylinder can be assured, so as to intensify the contact drying.

Because the support device on which the pressing rolls are fastened comprises at least two pressing devices 51 by which the support device can be moved against the drying cylinder, the circumferential region on which additional pressure acts can be varied. Either the pressing device in the region of which the paper web initially enters is more strongly activated than the pressing device which follows it, as seen in the direction of travel of the paper web, or vice versa. As can be noted from either of curves IV or V, this displaces the sinusoidal pressure distribution with reference to the central plane 47 of the drying cylinder.

In addition, use of several pressing devices distributed over the width of the paper web enables a predetermined distribution of the pressures to be obtained. This requires corresponding suspension of the pressing rolls, so that they can be acted on specifically in given regions with additional pressures.

Figure 10:
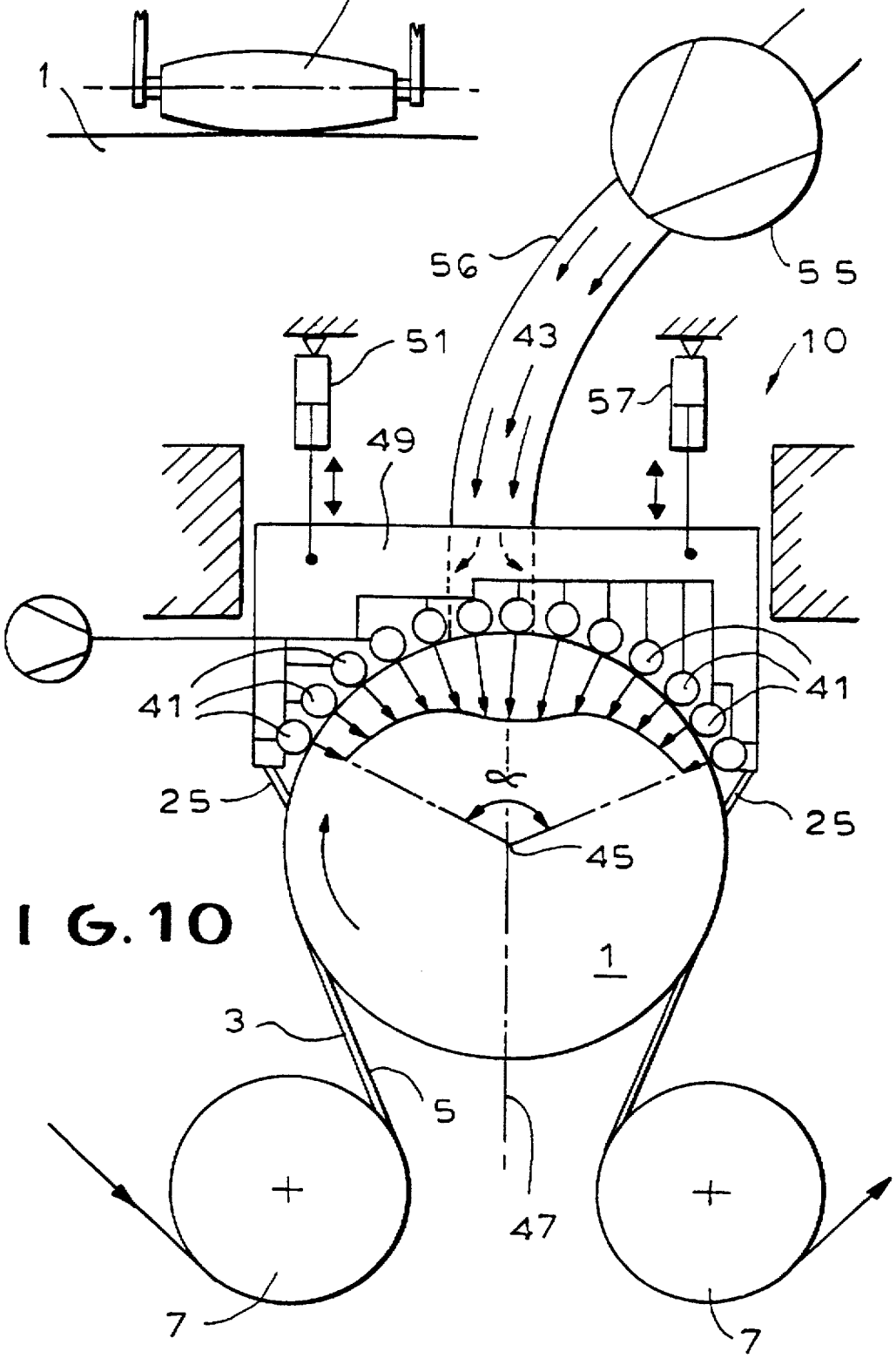
FIG. 10 is a diagram of a still further modified embodiment of a pressing device.

For example, as suggested in FIG. 10, the circumferential surfaces of the pressing rolls 41 can have circumferential grooves at spaced intervals along the roll in which suitable mounts are provided via which pressures transverse to the central axis of the pressing rolls can also be produced. The grooves in the pressing rolls should be so arranged that grooves of adjacent pressing rolls are offset in location so that finally, uniform pressing of the paper web against the surface of the drying cylinder is assured. The grooves also provide air lubrication of the rolls.

As shown in FIG. 5, the pressing rolls can be arranged with a roll housing of their own on the support device 49. The housing extends so far beyond the pressing rolls in the region of their circumferential surface that the rolls cannot fall out of the housing. It is possible to introduce lubricant, for instance air, water or oil under pressure, into the slit between the circumferential surface of the pressing rolls and the housing in order to reduce the frictional forces between the roll and the housing to a minimum.

It is furthermore conceivable to use magnetic rolls which, by suitable magnet devices, are mounted free of friction in the region of their support and remain operable practically without maintenance.

Furthermore, it is possible to arrange the roll housing which receives the pressing rolls with resilient spring action with respect to the support device 49 so as to assure the most uniform possible action of pressure on the circumferential surface of the drying cylinder. Such a suspension of the pressing rolls can be provided also in the embodiment in FIG. 4, in which the central axes of the pressing rolls are arranged on an imaginary arcuate line which extends substantially parallel to the circumferential surface of the drying cylinder. The use of such resiliently mounted pressing rolls is particularly preferred for the embodiment of the dryer section of FIG. 5, since in that case, the pressing rolls are arranged on an arcuate line having a radius of curvature which is greater than that of the drying cylinder. In this embodiment, to bring all pressing rolls into contact with the surface of the drying cylinder, the pressing rolls which first contact the surface of the cylinder must be able to move back or retract elastically with spring action into the support device. FIG. 5 shows that the differences between the radii of the line of curvature and of the drying cylinder should not be too great, or else the outermost pressing rolls would no longer be able to be brought into contact with the drying cylinder.

Two or more adjacent pressing rolls can also be suspended by support elements which receive two or more adjacent pressing rolls, which, in their turn, are connected to the support device 49. To better compensate for tolerances, the support elements can also be swingable with respect to the support device. It is also possible to fasten the support elements under spring action with respect to the support device and then to use them in the embodiment shown in FIG. 5.

Figure 9:
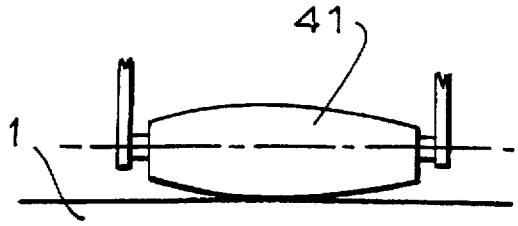
FIG. 9 is a view at the circled detail of FIG. 8.

If deemed necessary, pressing rolls or partial pressing rolls, as illustrated in FIG. 9, which are arcuate in shape along their axes and which follow an arcuate line which is curved in the direction of the drying cylinder can be used, so that the pressing rolls or partial pressing rolls first contact the drying cylinder at their axial direction central region and, upon further pressing, develop maximum pressure in the central region of the drying cylinder.

In view of the above, the pressing rolls used in the embodiments shown in FIGS. 4, 5 and 10 can also be fastened to so called blast boxes 55 shown in FIG. 10, which are acted on by air or steam under pressure and communicate through the respective duct 56 into the support device 49. The drying behavior of the paper web can be additionally influenced in this manner particularly if the temperature in the blast boxes for the pressing rolls is varied over the circumferential surface of the drying cylinder.

From what has been stated above, the two embodiments of FIGS. 4 and 5 can be used in dryer sections having several drying cylinders and the pressure of the pressing rolls 41 of the different pressing devices 43 is adjustable separately for each drying cylinder. It is further possible to arrange several pressing rolls on support elements which are arranged on a common support device or which have support devices of their own and can be controlled separately. This makes it possible to create zones of different pressure distributed over the circumference of the drying cylinder, similar to the case of the pressure boxes. In such cases, it is possible to provide the zones of the successive pressing devices of several drying cylinders in each case with the same pressures to provide a dryer section similar to that explained with reference to FIG. 2. Furthermore, it is possible to associate pressing devices 43, each provided with pressing rolls, with several drying cylinders and in each case to provide zones of different pressures in the pressing devices. The zones operate with different pressures completely independent of each other. This provides a dryer section which is similar to the one shown in FIG. 3.

It is clear that the pressures can be adjusted in very variable fashion. It has also been shown that, even with a very slight pressure, for instance 0.05 bar, additional pressure is applied which corresponds approximately to a doubling of the maximum wire pressures customary today. This means that the pressures can be very effectively increased with a pressing device developed as a pressure box.

The above descriptions of FIGS. 1 to 5, 7, 8 and 10 make it clear that the pressures can be adjusted to the desired values both over the circumference of the drying cylinders and also over their length. Thus, the heat transfer within the dryer section can be adjusted individually or locally. By establishing an increase in the differential pressure at the inlet into the dryer section, it is further possible to squeeze out an air cushion based, for instance, on entrained air and in this way to also positively affect the drying properties by an improved transition of heat. This particular advantage can be obtained without additional measures.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dryer section of a machine for manufacturing a paper web, the dryer section including at least one heatable drying cylinder with a circumferential surface on which the paper web is wrapped to be heated;

a web support belt, guide means for guiding the belt to wrap over part of the surface of the cylinder and to wrap over the web to be dried on the cylinder;

a pressing device located outside the cylinder for pressing the web against the cylinder, the pressing device including means for applying differing pressures over respective regions alone the width of the surface of the drying cylinder.

2. The dryer section of claim 1, wherein the pressing device further includes means for applying differing pressures over respective regions of the surface of the cylinder around the circumference of the cylinder.

3. A dryer section of a machine for manufacturing a paper web, the dryer section comprising:

at least one heatable drying cylinder with a circumferential surface on which the paper web is wrapped to be heated;

a web support belt;

guide means for guiding the web support belt to wrap over part of the surface of the cylinder and to wrap over the paper web to be dried on the cylinder; and a pressure box disposed outside the cylinder and the web support belt above the paper web for pressing the paper web against the cylinder.

4. The dryer section of claim 3, wherein the pressing device comprises a plurality of pressing rolls, each having a respective central axis, the central axes of the pressing rolls being arranged substantially parallel to each other and to the axis of rotation of the cylinder and being disposed on an imaginary generally arcuate line outside the cylinder and outside the support belt; at least some of the pressing rolls being positioned for applying pressure to the support belt.

5. The dryer section of claim 4, wherein at least some of the pressing rolls are shorter in length than the width of the web, and at least some of the shorter pressing rolls are arranged one behind the other with those arranged one behind the other having their respective central axes substantially aligned.

6. The dryer section of claim 4, wherein the imaginary line on which the central axes of the pressing rolls are arranged has a radius of curvature which is at least equal to that of the drying cylinder.

7. The dryer section of claim 6, further comprising means elastically biasing the pressing rolls toward the support belt.

8. The dryer section of claim 6, further comprising a support device for holding the pressing rolls to be elastically biased toward the support belts.

9. The dryer section of claim 4, further comprising a support device for holding the pressing rolls at the support belt.

10. The dryer section of claim 9, further comprising two spaced apart pressing devices, independently actuatable for pressing the support device, and thereby the pressing rolls supported by the support device, toward the support belt.

11. The dryer section of claim 10, wherein the support device includes sectors thereof and the support device is adapted to be pressed sectorwise toward the cylinder for producing different pressures selectively in the direction of travel and transverse to the direction of travel of the web.

12. The dryer section of claim 4, wherein at least one of the pressing rolls is curved in shape in the direction across the web to apply pressures of different intensity along the central axis of the respective curve pressing roll.

13. The dryer section of claim 4, including a plurality of the drying cylinders, each cylinder having the surface on which the web is heated, the guide means guiding the support belt and the web to wrap over part of the surface of each of the drying cylinders;

a respective pressing device at at least some of the drying cylinders, and at least some of the pressing devices comprising a respective plurality of the pressing rolls.

14. A dryer section of a machine for manufacturing a paper web, the dryer section including:

at least one heatable drying cylinder with a circumferential surface on which the paper web is wrapped to be heated;

a web support belt, guide means for guiding the belt to wrap over part of the surface of the cylinder and to wrap over the web to be dried on the cylinder;

a pressure box located outside the cylinder for pressing the web against the cylinder, the pressure box includes respective zones therein at different locations over the surface of the cylinder and at each zone a respective pressure can be applied.

15. The dryer section of claim 14, wherein the respective zones of the pressure box over the surface of the cylinder comprise partial regions around the circumference of the cylinder.

16. The dryer section of claim 14, wherein the pressure box is acted upon by a pressure medium selected from the group consisting of compressed air, dry air and steam.

17. The dryer section of claim 14, wherein the different zones of the pressure box include means for delivering different respective pressures and the zones are located so that different pressures can be applied selectively to the surface in the circumferential direction or transversely to the circumferential direction.

18. The dryer section of claim 17, further comprising means at each of the zones for enabling variation of pressure at each zone.

19. The dryer section of claim 14, further comprising a plurality of the drying cylinders, each having a circumferential surface, and the guide means guiding the support belt and the web to wrap over a respective part of the surface of each of the drying cylinders; and a respective pressure box at at least some of the drying cylinders for pressing the support belt toward the respective part of the surface of the drying cylinder.

20. The dryer section of claim 19, wherein each of the pressure boxes includes respective zones therein at different locations over the cylinder surface, and at each zone a respective pressure can be applied.

21. The dryer section of claim 20, further comprising means for setting the pressure in each of the zones of each of the pressure boxes at each of the drying cylinders so that the pressures at the zones at each of the drying cylinders is the same.

22. The dryer section of claim 20, further comprising means at the zones adapted to supply respective pressure levels such that all of the pressure devices at all of the drying cylinders are independently controllable.

23. The dryer section of claim 14, wherein the zones of the pressure box are defined by respective pressure chambers and there are at least two of the pressure chambers arranged along the circumference of the drying cylinder; and means sealing each of the pressure chambers from the other and from the surroundings of the pressure box.

24. The dryer section of claim 23, wherein the sealing means between the pressure chambers and the surroundings permit such emergence of air as to establish a gentle pressure transition across each of the sealing means.

25. The dryer section of claim 14, wherein the pressure box is adapted for delivering different pressures selectively to the cylinder surface in the circumferential direction.

26. The dryer section of claim 14, wherein the pressure box is adapted for delivering different pressures selectively to the cylinder surface transversely to the circumferential direction.

* * * * *